US007121219B1

(12) United States Patent
Stallings

(10) Patent No.: US 7,121,219 B1
(45) Date of Patent: Oct. 17, 2006

(54) BOAT CONTROL SYSTEM

(76) Inventor: James Stallings, 5432 Fm 415, Timpson, TX (US) 75975

( * ) Notice: Subject to any disclaimer, the term of this patent is extended or adjusted under 35 U.S.C. 154(b) by 0 days.

(21) Appl. No.: 11/135,410

(22) Filed: May 24, 2005

(51) Int. Cl.
*B63H 25/46* (2006.01)

(52) U.S. Cl. ..... 114/151; 440/6

(58) Field of Classification Search ..... 114/151; 440/6, 88 C
See application file for complete search history.

(56) References Cited

U.S. PATENT DOCUMENTS

| | | | | |
|---|---|---|---|---|
| 3,517,633 | A | 6/1970 | Wanzer | |
| 3,675,611 | A | 7/1972 | Glass | |
| 3,791,331 | A * | 2/1974 | Dilley | 440/6 |
| 3,911,851 | A | 10/1975 | Canazzi | |
| 4,030,442 | A | 6/1977 | White | |
| 4,056,073 | A | 11/1977 | Dashew et al. | |
| 4,423,696 | A | 1/1984 | Aker | |
| 4,747,359 | A | 5/1988 | Ueno | |
| 4,807,552 | A | 2/1989 | Fowler | |
| 4,854,902 | A | 8/1989 | Havins | |
| 5,129,846 | A | 7/1992 | Dimijian | |
| 5,140,926 | A | 8/1992 | Denston | |
| 5,158,033 | A | 10/1992 | Evans | |
| 5,362,269 | A * | 11/1994 | Leach | 441/65 |
| 5,401,195 | A | 3/1995 | Yocom | |
| 5,501,072 | A | 3/1996 | Plancich et al. | |
| 5,642,684 | A | 7/1997 | Aker | |
| 6,024,038 | A | 2/2000 | Kiliz et al. | |
| 6,142,841 | A | 11/2000 | Alexander, Jr. et al. | |
| 6,273,015 | B1 * | 8/2001 | Motsenbocker et al. | 114/61.12 |
| 6,325,683 | B1 | 12/2001 | Yocom | |
| 6,350,164 | B1 | 2/2002 | Griffith, Sr. et al. | |
| 6,363,874 | B1 | 4/2002 | Griffith, Sr. | |
| 6,371,038 | B1 | 4/2002 | Beauchamp et al. | |
| 6,447,349 | B1 * | 9/2002 | Fadeley et al. | 440/41 |
| 2002/0005156 | A1 * | 1/2002 | Duncan | 114/151 |

FOREIGN PATENT DOCUMENTS

| | | |
|---|---|---|
| JP | 10-86895 | 4/1998 |
| JP | 2002-87389 | 3/2002 |

OTHER PUBLICATIONS

"Turbodrive 490 H. C., " Castoldi Jet, available at: http://www.castoldijet.it/images/depliant/TD490HC.pdf, 4 pages, printed from the Internet Dec. 29, 2004.
"Bow Thrusters," BCW Marine Products, available at: http://www.sideshift.net/bow_thruster.htm, 4 pages, printed from the Internet Dec. 29, 2004.
"Stern Thrusters," BCW Marine Products, available at: http://www.sideshift.net/stern_thruster.htm, 3 pages, printed from the Internet Dec. 29, 2004.
"Hydraulic Thrusters," Side-Power Thrusters, available at: http://sidepowerthrusters.com/default.asp?grp=1&cnl=2, 2 pages, printed from the Internet Dec. 29, 2004.

* cited by examiner

*Primary Examiner*—Stephen Avila
(74) *Attorney, Agent, or Firm*—Richard C. Litman

(57) ABSTRACT

The boat control system of the invention is a propulsion system for controlling the direction of passage of a vessel underway at low speeds. Six thruster nozzles are installed around the hull so that, used individually or in combinations, the boat can be maneuvered forward, backward, laterally or turned on its axis. The impeller pumps are operated by a water cooled reversible DC electric motor which allows the thruster apparatus to operate for long periods.

14 Claims, 4 Drawing Sheets

BOAT CONTROL SYSTEM

BACKGROUND OF THE INVENTION

1. Field of the Invention

The invention disclosed herein relates to a propulsion system for controlling the direction of passage of a vessel underway at relatively low speeds without utilizing the power of the vessel's main engine(s). The invention particularly relates to combinations of water thrusters installed in the bow and stern of vessels, especially power and sail pleasure boats, that can selectively propel the craft forward or backward or laterally. The system's design allows the thruster apparatus to operate for long periods without overheating.

2. Description of the Related Art

The use of thrusters as a means of enhancing the turning capability of a boat or ship is well known in the marine arts. When maneuvering to enter or exit a dock or marina, small single engine boats of at least thirty plus feet in length and ships of any length are in tight quarters and are at the mercy of the prevailing current, wind direction and the tendency for a single engine prop to turn the boat's stern. A miscalculation in where the boat's engine, just turning above stalling RPM, and the boat's corresponding momentum will take the craft can result in an ever so seemingly light contact with a bulkhead or another boat in its slip. Yet, that light contact damage will cost thousands of dollars to remedy. But the experienced boater knows the risk can be remedied by installing bow thrusters. They can turn the bow quicker in short distances than a rudder and engine combination that gives the Captain more control.

A pair of thrusters can also be installed in the stern of the boat, preferably connected to the transom. These provide a capability to turn the stern laterally and, in consort with the bow thrusters, rotate the boat on its axis. They also are a great assist to single engine boats when they are backing into a slip. Depending on which way the engine shaft rotates, the boat's prop in reverse gear turns the stern of the boat to port or starboard but with stern thrusters installed and operating to port or starboard this tendency can be balanced to allow the boat to back straight into the slip.

Another advantage of bow and stern thrusters is their capability to move the boat forward or backward at extremely slow speed when operated in tandem. When entering a crowded fairway of a marina, the flow of the thrusters can be directed to the stern of the boat and thereby provide a small forward motion to the vessel with an instant capability to turn the vessel if so necessary.

One problem that compromises the scope of use of bow or stern thrusters in the current art is the use of air-cooled electric motors to power the thrusters. Under air-cooling, the electric motors heat up and must be shut down before they are damaged. Therefore, they cannot be used continuously during a cruise so some of their advantages are not always available to the Captain. Nor can they be used for trolling in open waters. However, the instant invention overcomes that problem.

U.S. Pat. No. 3,675,611 to Glass describes a boat having a plurality of water jet nozzles at the bow and stern to assist in steering the boat. The water-jet nozzles also provide auxiliary drive to propel the boat. As described, the water-jets of the patent are restricted to maneuvering in an about the marina and are not capable of extended, continuous operation. The patent does not overcome the problems resolved by the instant invention.

U.S. Pat. No. 3,911,851 to Canazzi describes bow thrusters and stern thrusters for maneuvering a boat in confined places. The four thrusters receive their stream of water from a single point source which distributes the water to the thrusters from four circumferentially spaced outlet ports at ninety degree interval. Precise lateral movement of the boat under this feed configuration is questionable as is the net forward thrust provide to the boat when all four thrusters are in play.

Thus, a boat control system solving the aforementioned problems is desired.

SUMMARY OF THE INVENTION

A boat control system of the instant invention for independently steering or propelling a boat at low speed consists of six thruster ports and nozzles or three pressure and three suction thruster nozzles receivable connected to water pumps containing two reversible impellers. The pumps are driven or operated by water cooled DC reversible electric motors connected to the boats battery bank or the main engine electric system. Four of the thrusters are installed through the hull of the boat and one thruster is installed amidships in the stern, preferably through the transom. All of the thrusters are installed just below the water line or displacement line on the hull or transom and obliquely eject pressurized water down into the seawater. The ejection of the pressurized water into the seawater by the thrusters produces an opposite reaction force that effects a turning moment on the hull of the boat which, when the thrusters are operated selectively, turns or propels the craft to port or starboard, moves the boat laterally along the hull line to starboard or port, or propels the craft forward at low speed. The boat control system of the instant invention is capable of operating with any combination of thrusters in play from 1 to 5. Accordingly, there is a large selection of low speed turning and propulsion options available to the Captain of the vessel simply from the choice of thrusters to operate. The craft can be propelled forward at low speed or rotated in place on its axis or propelled laterally as in an approach to a crowded gas dock. Some of these maneuvers are well beyond the scope of the boat's main engine(s) to accomplish, particularly at very low speeds.

Thruster systems of the prior art are typically not placed in operation in open waters for their usefulness in open waters requires long periods of operation compared to their operation in congested marinas and back waters. Prior art thruster systems are operated by air cooled DC electric motors installed in the hull in relatively hot locations on the boat. Accordingly, protracted continuous operation of these thruster system motors in open water overheats the motors and causes severe damage. However, it has been discovered that this drawback of prior art thruster systems can be overcome by operating the thruster system with reversible direct current water cooled electric motors.

The advantages of operating the thruster system with water cooled motors are significant. As a result of the instant invention, the thruster system of the invention can be used to propel the boat for long periods at low speeds previously unattainable with the high horse power main engine(s). Consequently, when trolling for fish a separate, outboard trolling motor is no longer necessary. The thrusters of the invention can maintain low trolling speeds for long periods so the need for a trolling motor is overcome.

The long operating hours attainable by the thruster system of the instant invention provides another important advantage to the boat owner. Fuel efficiency! Very often, a relaxing day of boating consists mainly of very slow cruising around an attractive river or bay with family and friends. The main boat engine(s) can propel the boat slowly enough at very low revolutions per minute, but also at very low fuel efficiency plus exhaust smoke and noise. The thruster system of the instant invention overcomes that disadvantage when tied in to the rechargeable battery bank of the boat. The desirable slow gentle speed can be achieved with only two or more thrusters on and the main engine(s) off. No fuel is consumed and the exhaust fumes and combustion noises are gone.

Three reversible water cooled electric motors are used in the boat thruster system of the invention: one in the bow and two in the stern of the boat. These motors are each connected by a drive shaft to a pump containing two impellers of opposite rotation and water inlet and outlet apertures or holes or openings. The outlet aperture of the pump is connected preferably by a hose means to the starboard and port bow thruster nozzles at the thruster apertures in the hull just below the port and starboard high water line. The water inlet aperture of the pump is receivably connected, preferably by hose, either to an outlet water aperture on the water cooled reversible motor heat exchanger casing or to a first water intake aperture through the hull below the starboard or port water line.

The water cooled reversible electric motor is contained in a metal heat exchanger casing. An aperture on the heat exchange casing is receivable connected either to the water intake through hull aperture. The water passes through the motor casing and exits the heat exchanger through another aperture which is connected by hose or conduit to the water intake opening on the pump housing.

While the foregoing explanation of the thruster and motor installation is directed to the bow thruster, the two stern installations of pumps and water cooled electric motors are similar to the bow thruster installation. One stern installation provides an operational thruster to the stern port side and to the stern starboard side just below the high water line. The inlet water for the pump can be acquired from the motor heat exchanger casing or, optionally, taken directly from a stern hull aperture placed in the hull below the stern or forward propulsion thruster water line. The second stern installation includes a thruster directing a stream of pressurized water into the sea directly aft of the transom for forward propulsion. The exact placement of the stern forward propulsion thruster nozzle shall be determined by one skilled in the art at the site as the stern design of both power and sail boats vary significantly from manufacturer to manufacturer. However, the thruster nozzle shall be obliquely directed downward into the water from a placement several inches below the stern water line.

Each of the three reversible, water cooled DC electrical motors for the bow, stern and transom thruster installations is fully wired and connected to a battery bank and a thruster control joystick at the Captains wheel station. The instrumentation at the control joystick is known to those skilled in the art and allows the Captain to select, start up and shut down any combination of thrusters for maneuvering the boat. Each independent pump is equipped with two impellers. Through the reversibility of the motor, the Captain can select either the starboard or port side impeller to become engaged and discharge sea water through the selected thruster nozzle to turn the bow. In a similar manner, the stern thruster installation can be energized to operate either the port or starboard impeller to turn the boat's stern. If the Captain prefers, both bow and stern thruster installation can be made operational simultaneously.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
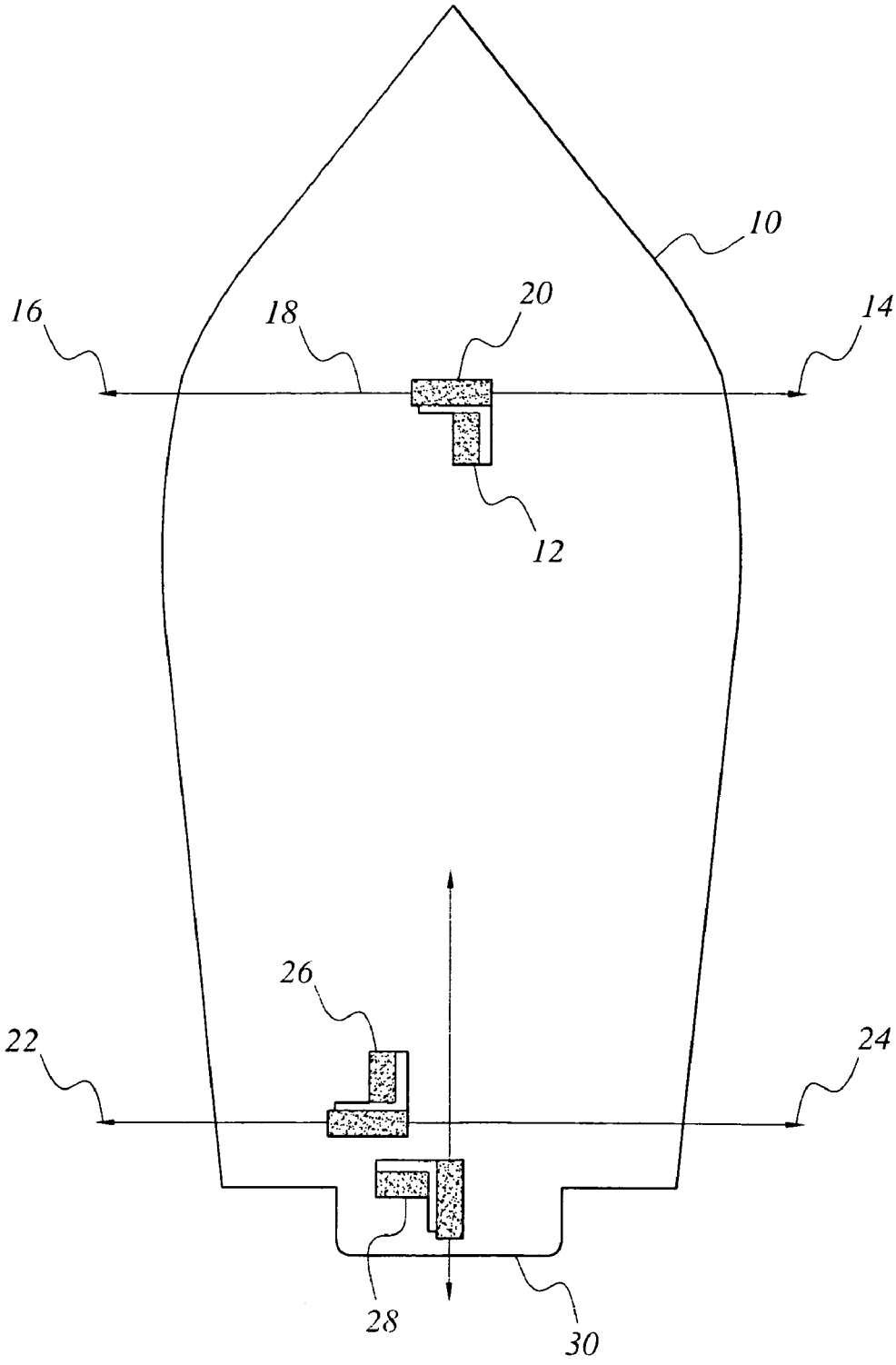
FIG. 1: The FIG. 1 is a directional overhead view of the thruster installation in a boat.

Referring to FIG. 1, an overhead view (10) is presented showing the general shape of a boat. The bow thruster impeller pump (20) and reversible electric motor (12) is installed in the hull centered between the hull sides. The bow thruster nozzles (14 and 16) are connected to the pump (20) by flexible piping (18). For the stern side lateral thrusters (22 and 24) and reversible electric motor and impeller pump (26), they are installed in the hull close to the center line of the hull. The forward and reverse unit comprising the reversible electric motor and water impeller pump (28) is installed in the center line of the hull next to the transom (30) with one thruster nozzle installed on the stern and receivably connected to the pump. The forward thruster nozzle is pointed obliquely down and to the rear into the sea water The system illustrated in FIG. 1 offers 360 degree thrust angles including true straight lateral movement. The thruster units are controlled by one 3 axis joy stick.

Figure 2:
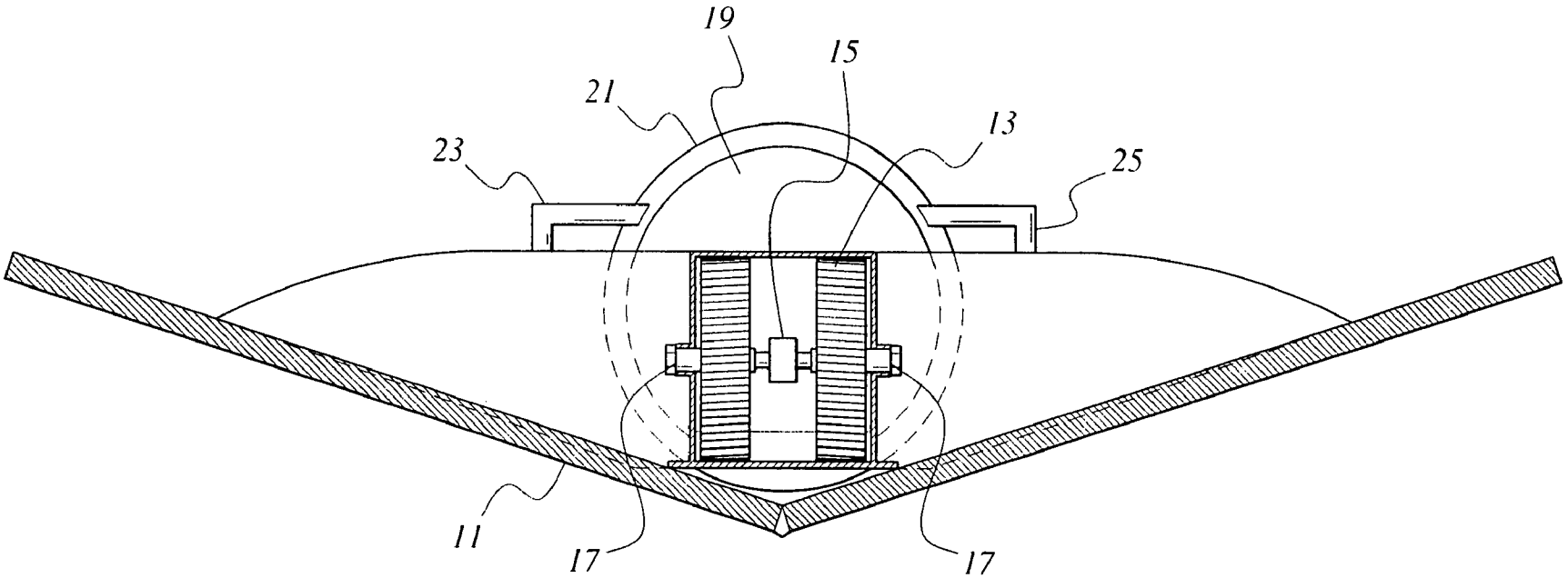
FIG. 2: The FIG. 2 is a longitudinal view of the bow thruster viewed from the transom.

Referring to FIG. 2, a view is presented of the bow lateral thruster taken from the transom. The keel of the boat is shown as (11) with the pump impellers shown as (13) and right angle drive shown as (15) and bearings (17). The water cooled reversible electric motor (19) is encased in a water cooling jacket (21) having water circulating line (23) and (25).

Figure 3:
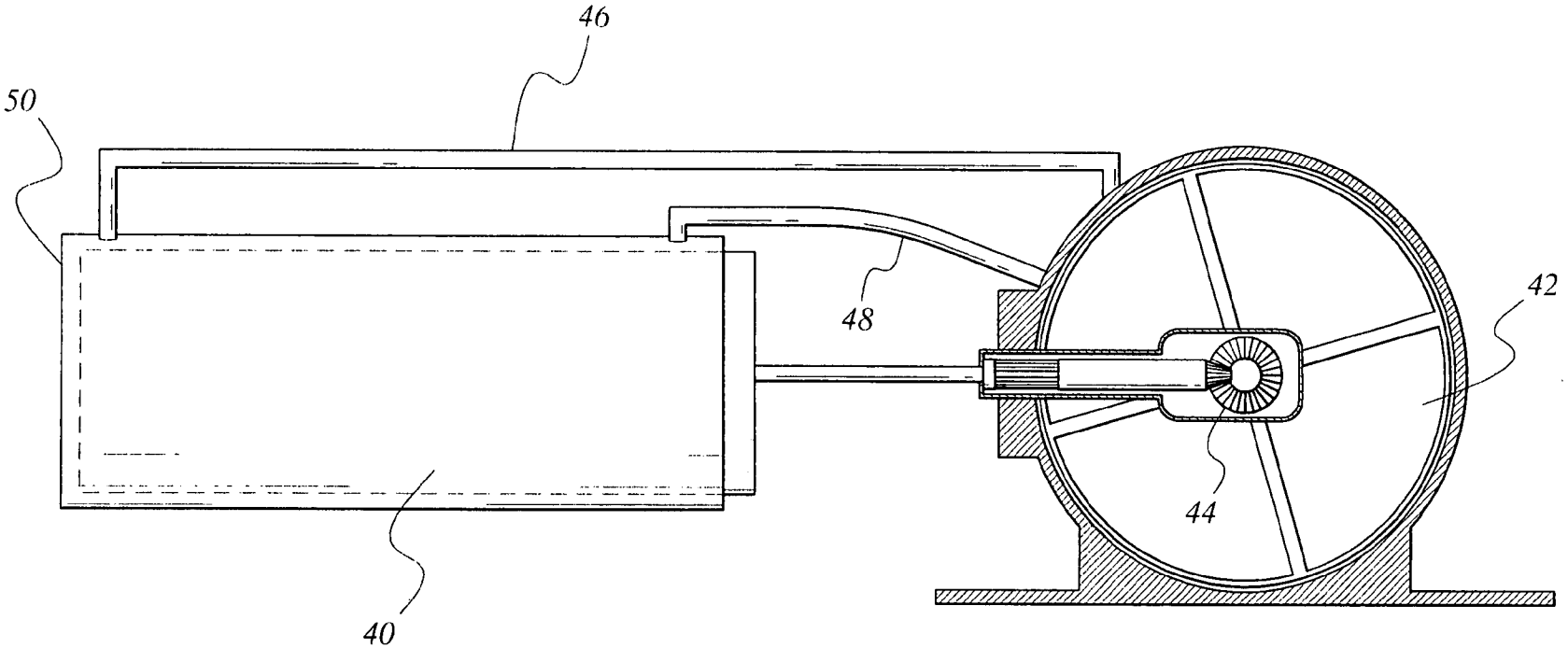
FIG. 3: The FIG. 3 is a side view of the bow thruster set up illustrating the cooling water installation for the electric motor and impeller.

Referring to FIG. 3, a view is presented of the bow lateral thruster taken from the side. The view shows the electric motor (40) connected to impeller (42) via a right angle drive (44). Cooling water supply and return line (46) and (48) to the electric motor heat exchanger casement are shown as (50).

Figure 4:
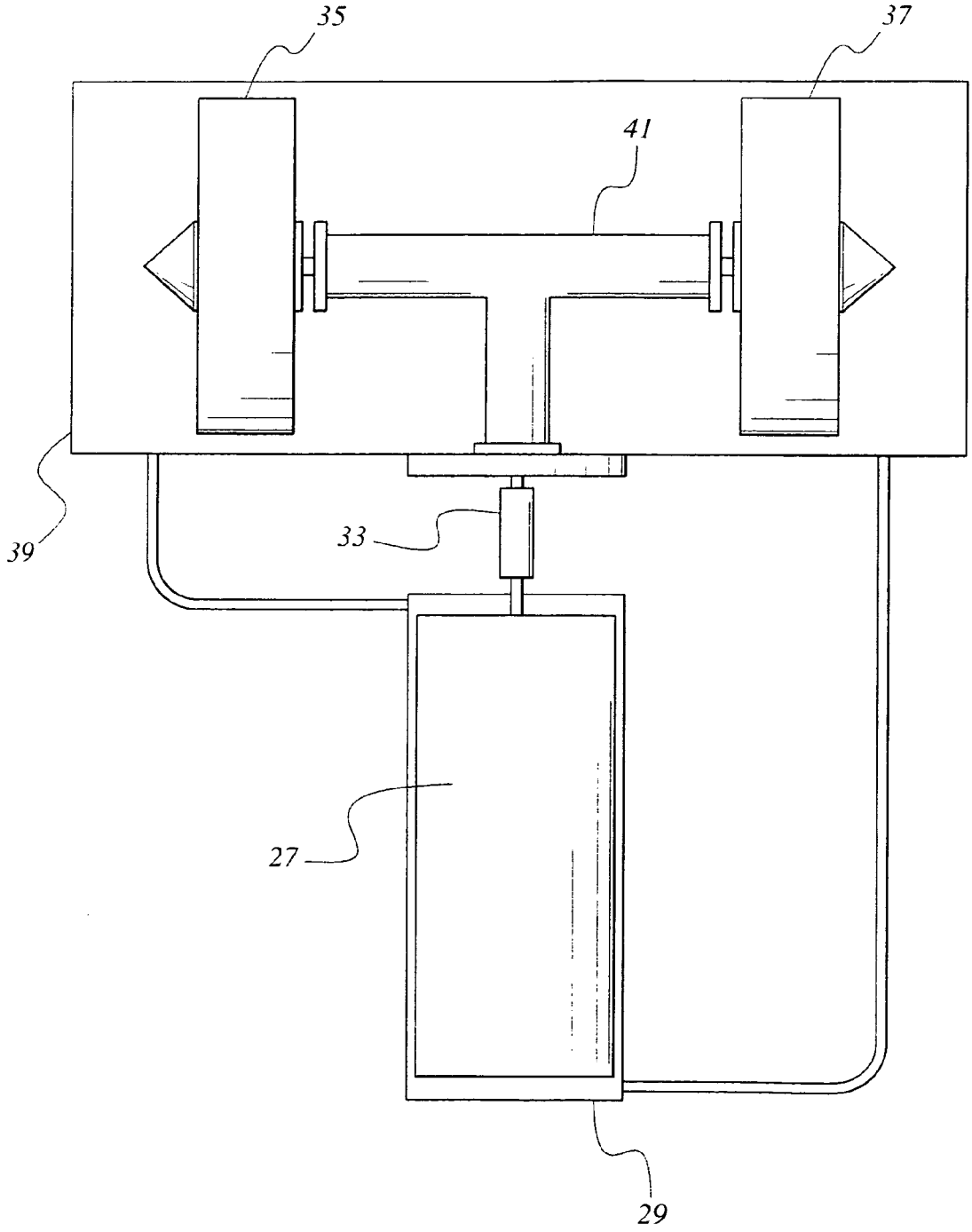
FIG. 4: The FIG. 4 is an overhead view of the integrated motor and thrusters installation.

Referring to FIG. 4, another overhead view is presented of the pump and electric motor of the instant invention. The water cooled, reversible DC electric motor is shown at (27) with motor cooling water enclosure (29) and motor cooling water supply line (29). The motor shaft is connected to the pump drive by drive coupler (33). The pulp impellers (35) and (37) are encased in an aluminum tube (39). The body of the pump includes a right angle gear drive (41). A sea water feed circulation line (not shown) is included from an available raw sea water inlet source or ptovided thriogh a conduit from another aperture in the hull below the boat's sea water line.

A particularly attractive advantage of the instant invention over prior art bow and stern thrust systems is that the system of the invention can control the boat to move in a true straight lateral movement. Other combination bow and stern thruster systems can move a boat laterally but an accurate bow and stern balance in thrust is rarely achieved. As a result, the bow or stern thrust is favored and the lateral movement of the boat quickly becomes angular. The boat control system of the invention overcomes that problem.

It is to be understood that the present invention is not limited to the embodiments described above, but encompasses any and all embodiments within the scope of the following claims.

I claim:

1. A boat control system for independent steering or propelling of a boat at slow speeds, said system comprising:

Three pressure and three suction thruster nozzles for moving pressurized sea water, said nozzles installed through the hull and transom apertures below the boat's water line;

at least three impeller containing pumps to receive seawater and pump pressurized sea water to the nozzles;

at least three water cooled direct current drive electric motors each connected to one of the pumps to selectively rotate the pump impellers and pressurize seawater, said motors containing seawater heat exchanger having a seawater inlet means and a sea water outlet means directed to said pump, wherein the pumps and motors are combined to form thruster assemblies; and electrical control system joystick connected to the motor with means to selectively turn on individual impellers at an operators console.

2. The boat control system of claim 1 containing hull aperture below the boat seawater line, said aperture connected to the electric motor heat exchanger seawater inlet means.

3. The boat control system of claim 1 wherein said sea water from the heat exchanger outlet means is passed to the pumps for discharge.

4. The boat control system of claim 1 wherein the electric motor and pump assemblies are installed in the boat below the boat's sea water line.

5. The boat control system of claim 1 wherein one assembly is installed in the bow of the boat below deck atop the keel with impeller pressurized discharges directed toward the starboard and port bow.

6. The boat control system of claim 5 wherein the pump impellers pressurized water discharges are individually connected to port side and starboard side thruster nozzles by conduits.

7. The boat control system of claim 1 where in one assembly is installed in the stern of the boat below deck atop the keel with impeller discharges directed to the port and starboard stern of the boat.

8. The boat control system of claim 7 wherein the pump impellers pressurized water discharge are individually connected to port side and starboard side thruster nozzles by conduits.

9. The boat control system of claim 1 wherein one assembly is installed in the stern of the boat below deck atop the keel with impeller discharges directed fore and aft.

10. The boat control system of claim 9 wherein the pump impellers pressurized water discharges are individually connected to fore and aft thruster nozzles by conduits.

11. The boat control system of claim 9 wherein one thruster nozzle is installed pointing aft in an aperture on or near the transom and the second thruster nozzle is installed pointing forward or aft in an aperture through the bottom of the hull under the cockpit.

12. The boat control system of claim 11 wherein said nozzles are connected to the impeller by conduit.

13. The boat control system of claim 1 having six thruster nozzles for moving pressurized sea water.

14. The boat control system of claim 1 providing 360 degree thrust angles including true straight lateral movement.

* * * * *